US006160516A

United States Patent [19]

Teran et al.

[11] Patent Number: 6,160,516

[45] Date of Patent: Dec. 12, 2000

[54] DUAL PATTERN ANTENNA FOR PORTABLE COMMUNICATIONS DEVICES

[75] Inventors: James Emanuel Teran, Chandler; Archer David Munger, Mesa, both of Ariz.

[73] Assignee: Motorola, Inc., Schaumburg, Ill.

[21] Appl. No.: 09/414,110

[22] Filed: Oct. 7, 1999

[51] Int. Cl.[7] ..... H01Q 1/36

[52] U.S. Cl. ..... 343/702; 343/895; 343/853

[58] Field of Search ..... 343/895, 702; 455/90, 575

[56] References Cited

U.S. PATENT DOCUMENTS

| | | | |
|---|---|---|---|
| 5,450,093 | 9/1995 | Kim | 343/895 |
| 5,828,348 | 10/1998 | Tassoudji et al. | 343/895 |
| 5,943,027 | 8/1999 | Thill et al. | 343/895 |

*Primary Examiner*—Hoanganh Le
*Assistant Examiner*—James Clinger
*Attorney, Agent, or Firm*—Jeff D. Limon; Frank J. Bogacz

[57] ABSTRACT

A dual pattern antenna (FIG. 1, 20) functions as a bi-filar or quadrifilar helical antenna depending of the location of the feed element (FIG. 4, 120). When the feed element (120), within the hollow dielectric tube (FIG. 4, 140), is used to feed the antenna (20) at a distal end portion (FIG. 4, 142) the antenna functions as a bi-filar helical antenna and exhibits a relatively omnidirectional radiation pattern (FIG. 3, 70). When the feed element is used to feed the antenna at a proximal end portion (FIG. 4, 141), the antenna (20) functions as a quadrifilar helical antenna having a radiation pattern which exhibits desirable gain properties in the area above the antenna (FIG. 4, 40). The use of capacitive coupling allows the feed element (120) to slide within the hollow dielectric tube (140) so that the pattern of the antenna can be quickly changed, thus making the antenna well-suited for portable communications devices such as satellite cellular telephones.

15 Claims, 5 Drawing Sheets

DUAL PATTERN ANTENNA FOR PORTABLE COMMUNICATIONS DEVICES

FIELD OF THE INVENTION

The invention relates generally to the field of communications and, more particularly, to antennas used in conjunction with portable communications devices.

BACKGROUND OF THE INVENTION

In a portable communications device, such as a wireless cellular telephone, it is desired for the device to be capable of receiving signals from a remote transmitter at all times. Thus, while the communications device is in a quiescent mode, in which the device is not actively engaged in a telephone call, the device must be capable of receiving ring alerts or pages from the remote station. Additionally, while the device is actively engaged in a telephone call, it must be capable of receiving and transmitting to the remote station.

When a wireless cellular telephone is actively engaged in a telephone call, the device is typically operated while in an upright orientation, consistent with a standing or seated posture of the particular user. Because of the relatively predictable orientation of the cellular telephone, any communications antenna used by the telephone to receive and transmit signals can be optimized to operate in the particular orientation. In a terrestrial cellular telephone, for example, the radiation pattern of the antenna is generally optimized to receive signals from and transmit signals to a remote station located near a 0 degree elevation angle relative to the user. Additionally, there is usually little need for significant antenna gain at large elevation angles.

In contrast, when a wireless cellular telephone is in a quiescent mode, the telephone may be oriented in any particular direction. Thus, the telephone may be placed on a horizontal surface corresponding to a countertop or the dashboard of an automobile, or may be in an upright position by way of a clip on the belt of a user. Thus, any communications antenna used by the telephone to receive and transmit signals must be capable of receiving signals from any direction. If the antenna is not capable of receiving signals from any particular direction, this results in the user not receiving calls which are directed to him or her. Additionally, as wireless cellular telephones continue to decrease in size, the antenna used within the telephone should require minimal volume in the quiescent mode with the antenna confined to a stowed position. When the telephone is actively engaged in a call, the antenna should extend in a telescopic fashion to a maximum length in order to ensure that the head of the user does not interfere with the radiation pattern of the antenna.

These constraints on the design of the antenna can be especially problematic when the portable communications device is a satellite cellular telephone. In a satellite cellular communication system, the satellite cellular telephone must be capable of receiving relatively low power signals which are transmitted from an orbiting satellite. This increases the gain requirements of the antenna used within the satellite cellular telephone, and increases the difficulty in conveying ring alerts from the satellite to the telephone. Additionally, when the satellite cellular telephone is actively engaged in a telephone call, the bulk of the energy transmitted by the telephone must be directed upward, where communications satellites are expected to be located.

Therefore, it is highly desirable for a portable communications devices, such as a satellite cellular telephone, to incorporate a telescopic antenna which possesses a dual radiation pattern. Such an antenna would allow reliable reception of ring alerts while the telephone is placed in a quiescent mode, and at any orientation, as well as provide reliable reception and transmission of communication signals from orbiting satellites while the user is actively engaged in a telephone call.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

DESCRIPTION OF THE PREFERRED EMBODIMENTS

A dual pattern antenna for portable communications devices allows a subscriber to transmit signals to and receive signals from an orbiting space vehicle using a directional radiation pattern when the antenna is fully extended and the device is oriented in an upright position. Additionally, there is virtually no antenna pattern degradation caused by interference from the head of the user. When the antenna is fully retracted and the device is placed in any orientation, the device is capable of receiving ring alerts and pages from the orbiting space vehicle. Further, when the antenna is fully retracted it can easily be stowed to the side of the communications device, thereby allowing the device to consume minimal volume. The antenna is inexpensive to produce, and well-suited for a variety of applications where directional and omnidirectional antenna patterns are desired.

Figure 1:
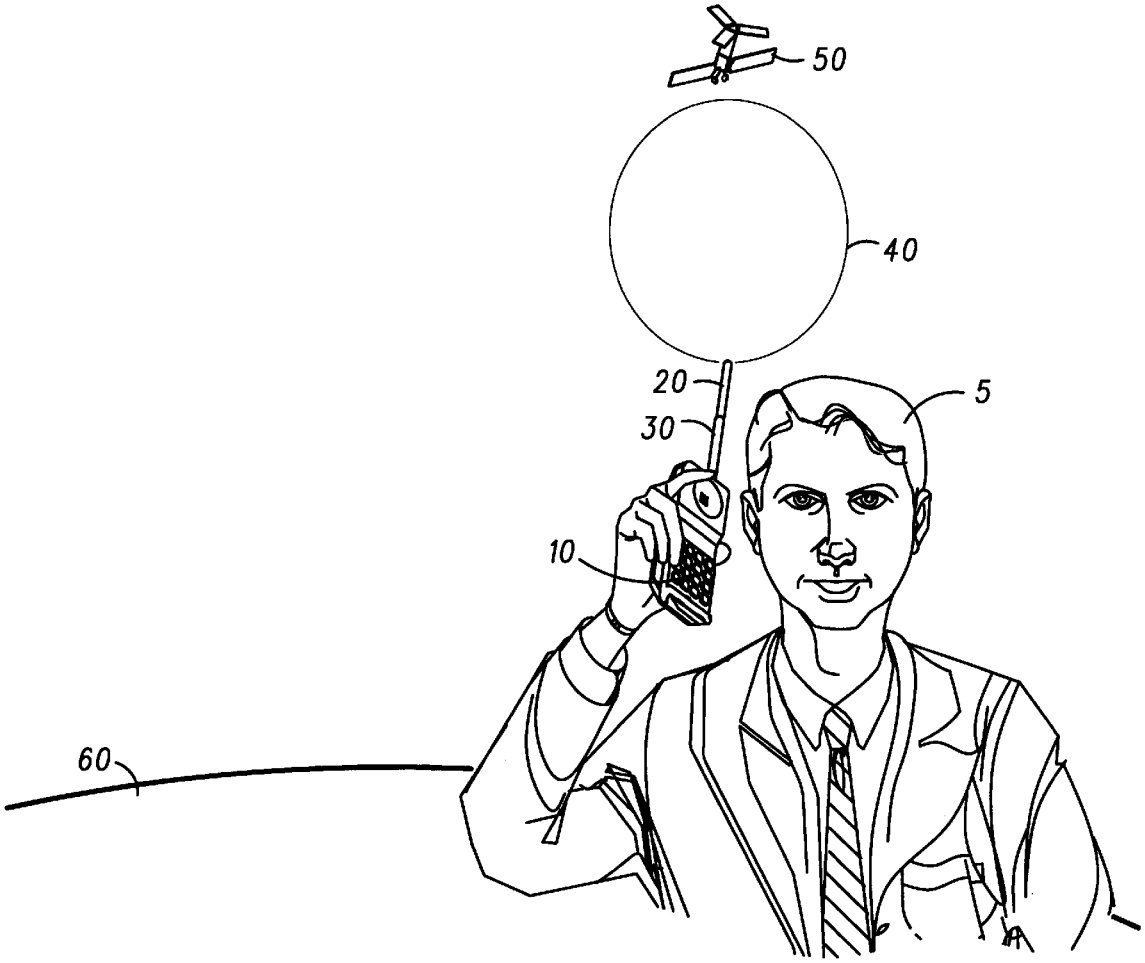
FIG. 1 is a diagram showing a subscriber actively engaged in a satellite telephone call using a dual pattern antenna for portable communications devices in accordance with a preferred embodiment of the invention.

FIG. 1 is a diagram showing a subscriber actively engaged in a satellite telephone call using a dual pattern antenna for portable communications devices in accordance with a preferred embodiment of the invention. In FIG. 1, subscriber 5, located on surface of the earth 60, is actively engaged in a telephone call using portable communications device 10. In a preferred embodiment, portable communications device 10 communicates with space vehicle 50 through active mode radiation pattern 40. Active mode radiation pattern 40 is used to convey messages from portable communications device 10 to space vehicle 50, and to receive messages from space vehicle 50 to portable communications device 10.

In a preferred embodiment, dual pattern antenna 20 is mechanically coupled to portable communications device 10 through stem 30. Stem 30 functions to allow dual pattern antenna 20 to radiate active mode radiation pattern 40 from a location completely above the head of subscriber 5 by way of coupling to a proximal end portion of dual pattern antenna 20. Through coupling at proximal end portion of dual pattern antenna 20, active mode radiation pattern 40 is generated and is not degraded by interference from the head of subscriber 5. Desirably, stem 30 fits within dual pattern antenna 20 and within portable communications device 10 the device is placed a quiescent mode. It is further desirable that dual pattern antenna 20 is stowed to the side of portable communications device 10 when placed in the quiescent mode, as shown in FIGS. 2 and 3, so as to require minimum volume.

Figure 2:
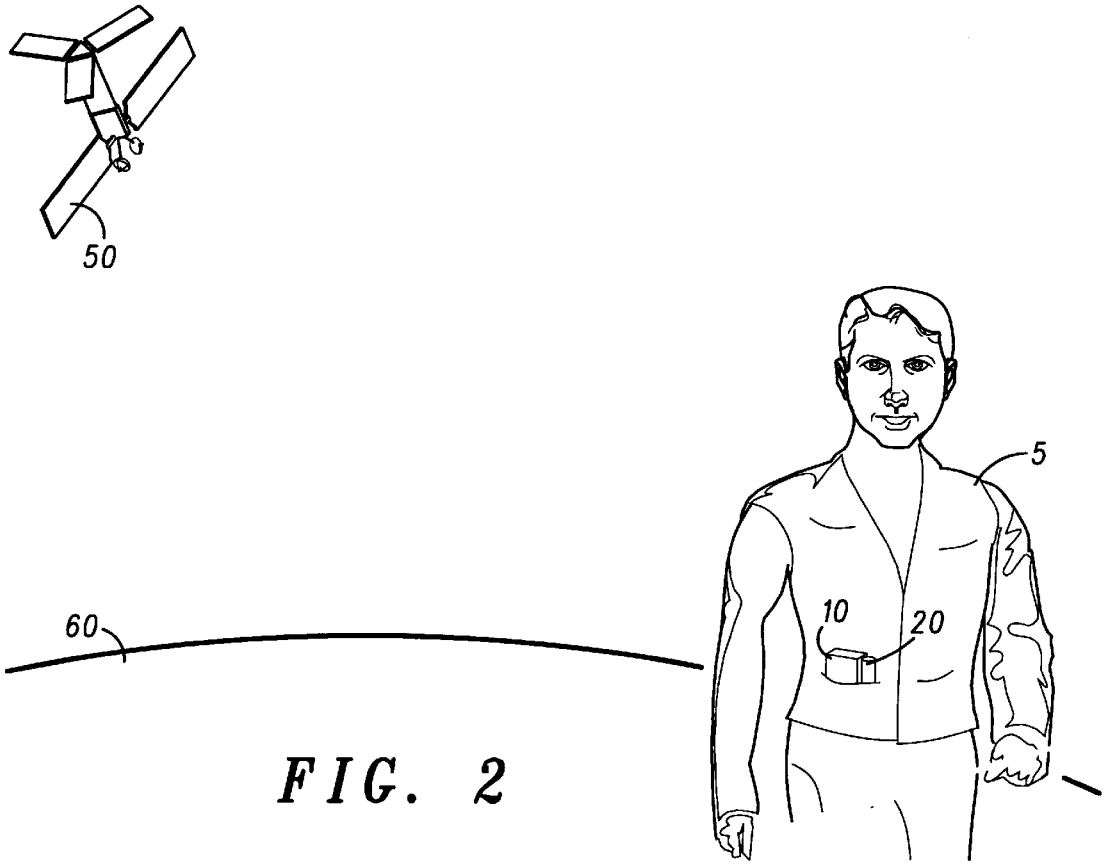
FIG. 2 is a diagram showing the portable communications device of FIG. 1 placed in a quiescent mode while fastened to an article of clothing worn by the subscriber of FIG. 1 in accordance with a preferred embodiment of the invention.

FIG. 2 is a diagram showing the portable communications device of FIG. 1 placed in a quiescent mode while fastened to an article of clothing worn by the subscriber of FIG. 1 in accordance with a preferred embodiment of the invention. In FIG. 2, portable communications device 10 requires minimal volume and can be fastened to the belt worn by subscriber 5, or placed within a purse or pocket of subscriber 5. In FIG. 2, dual pattern antenna 20 is shown as being stowed at a location to the side of portable communications device 10 with stem 30 fitting entirely within dual pattern antenna 20. In the quiescent mode, portable communications device 10 is capable of receiving ring alerts or pages from space vehicle 50, while subscriber 5 is located on surface of the earth 60.

Figure 3:
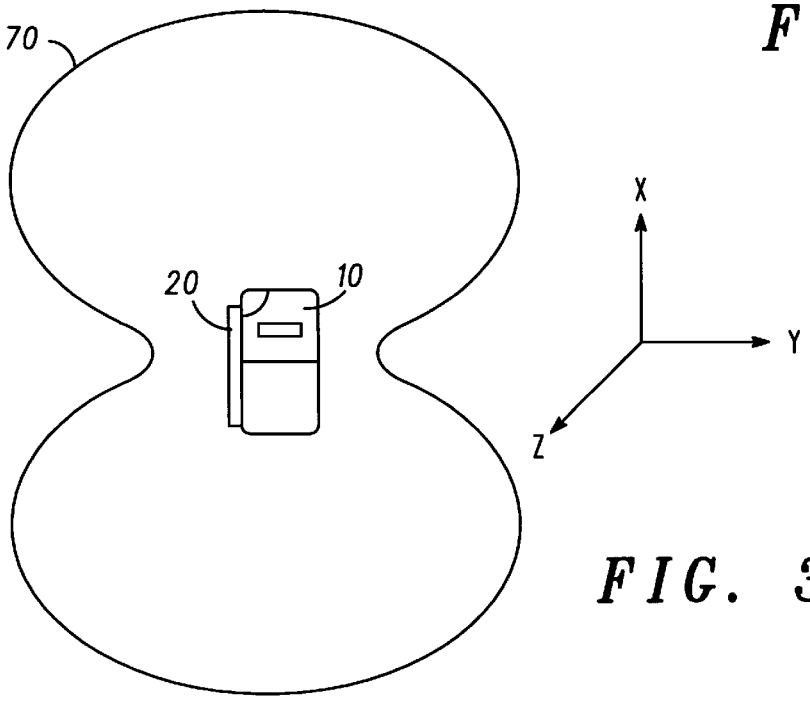
FIG. 3 is a diagram showing the radiation pattern of the dual pattern antenna for portable communications devices while a device is placed in a quiescent mode in accordance with a preferred embodiment of the invention.

FIG. 3 is a diagram showing the radiation pattern of the dual pattern antenna for portable communications devices while a device is placed in a quiescent mode in accordance with a preferred embodiment of the invention. In FIG. 3, quiescent mode radiation pattern 70 is shown as being substantially omnidirectional in the X-Y plane. Quiescent mode radiation pattern 70 exhibits no significant variations in the X-Z plane of FIG. 3. Desirably, dual pattern antenna 20 is stowed at a location to the side of portable communications device 10 with stem 30 fitting completely within the antenna. The substantially omnidirectional characteristic of quiescent mode radiation pattern 70 provides the capability for the antenna to receive signals from virtually any direction. Thus, portable communications device 10 can be placed in any orientation and still maintain the capability to receive ring alerts from a remote transmitter, such as space vehicle 50 of FIG. 2.

Figure 4:
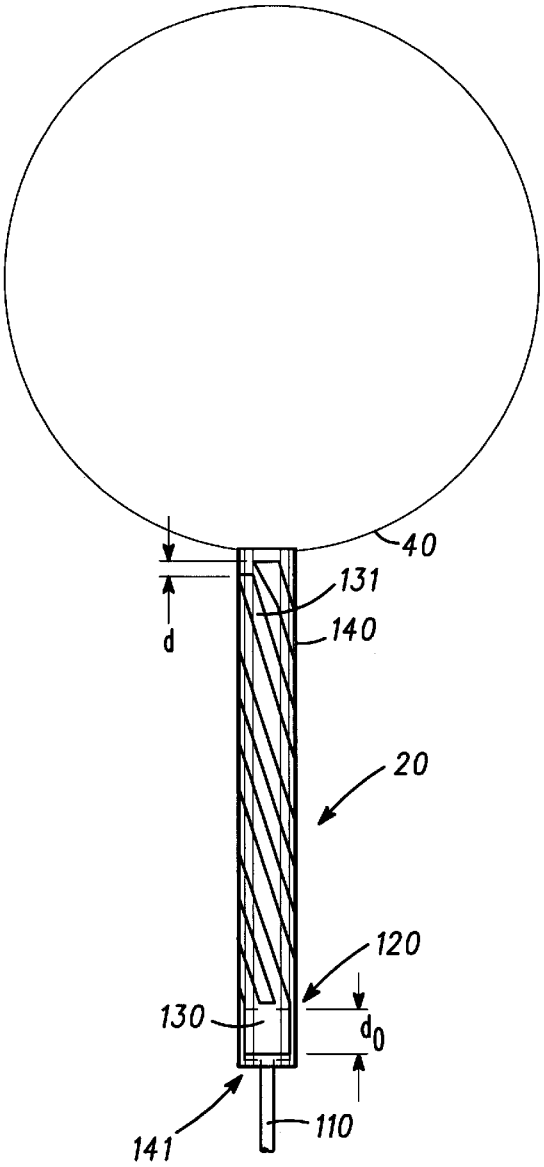
FIG. 4 is in an illustration of a first antenna pattern produced by a dual pattern antenna for portable communications devices as well as details of the antenna in accordance with a preferred embodiment of the invention.

FIG. 4 is in an illustration of a first antenna pattern produced by a dual pattern antenna for portable communications devices as well as details of the antenna in accordance with a preferred embodiment of the invention. Although not shown in FIG. 4, it is expected that a radome or other equivalent structure will partially or fully enclose the dual pattern antenna of FIG. 4 in order to ensure that environmental effects, such as dirt and moisture, do not come into contact the antenna.

In FIG. 4, hollow dielectric tube 140 is divided into proximal end portion 141, and distal end portion 142. Desirably, hollow dielectric tube 140 is substantially rigid, maintains a predictable dielectric constant, and possesses low loss characteristics. It is also desirable that hollow dielectric tube 140 possesses a substantially constant inner diameter. Affixed to the outside surface of hollow dielectric tube 140, are first and second pairs of conductive helical strips 130 and 131, which originate from within the area of proximal end portion 141 and terminate within the area of distal end portion 142.

As shown in FIG. 4, the elements of first pair of conductive helical strips 130 are joined together within the area of proximal end portion 141. In a preferred embodiment, the elements of second pair of conductive helical strips 131 are also joined together within the area of proximal end portion 141, located on the reverse side of hollow dielectric tube 140 (not shown in FIG. 4). The height of each region of first and second pairs of conductive helical strips 130 and 131 which consists of a single conductor is denoted by the dimension "$d_0$". This dimension is desirably determined by the amount of capacitive coupling needed between feed element 120 and first and second pairs of conductive helical strips 130 and 131.

The combination of first and second pairs of conductive helical strips 130 and 131 affixed to hollow dielectric tube 140 create a quadrifilar helical antenna. As known to those skilled in the art, a quadrifilar helical antenna will produce radiation pattern, similar to active mode radiation pattern, 40 where a substantial portion of energy is radiated to and received from regions located above the dual pattern antenna 20 of FIG. 4. Additionally, the shape of active mode radiation pattern 40 can be controlled by increasing or decreasing the length of first and second pairs of conductive helical strips 130 and 131.

In FIG. 4, feed element 120 couples energy to first and second pairs of conductive helical strips 130 and 131. In a preferred embodiment, feed element 120 is a coaxial cable terminated by way of a split-sheath balun. Thus, the outer conductor of coaxial cable 110 is terminated in one curved surface which is capacitively coupled to first pair of conductive helical strips 130 while the inner conductor of coaxial cable 110 is terminated in a second curved surface which is capacitively coupled to second pair of conductive helical strips 131 on the reverse side of FIG. 4. Further details describing the split-sheathed characteristics of feed element 120 are provided in reference to FIG. 5.

Due to the split-sheath configuration of feed element 120, the feed element is actually comprised of first and second feed elements, with the first feed element coupling to first pair of conductive helical strips 130, and the second feed element coupling to second pair of conductive helical strips 131. Desirably, coaxial cable 110 fits within stem 30, which has been cut away in order to show coaxial cable 110. Additionally, feed element 120 is placed at the leading end of stem 30, allowing positioning of the feed element through sliding stem 30 within hollow dielectric tube 140.

The split-sheath configuration of feed element 120 allows in-phase (0 degree) and out-of-phase (180 degree) excitation currents from feed element 120 to be coupled to first and second pairs of conductive helical strips 130 and 131 without requiring physical contact between the conductive helical strips and feed element 120. Thus, feed element 120 is free to slide within hollow dielectric tube 140 without making electrical contact with either first or second pairs of conductive helical strips 130 and 131.

It can be seen from FIG. 4 that one element of second pair of conductive helical strips 131 is of a slightly greater length than the second element of the pair. This differential length is denoted by the dimension "d". A differential length is desirable since it provides a self-phasing capability which allows one element of each pair of first and second conductive helical strips 130 and 131 of dual pattern antenna 20 to radiate with a signal of a different relative phase. For example, when feed element 120 couples a signal of 0 degrees relative phase onto first pair of conductive helical strips 130, the differential length in the two constituent helical strips causes one element to retain a 0 relative phase, while the element of shorter length assumes a 90 degree phase shift. Similarly, when feed element 120 couples a signal of 180 degree relative phase onto second pair of conductive helical strips 131 (on the reverse side of dual pattern antenna 20) the differential length of the to helical strips causes one element to retain 180 degree relative phase, while the other assumes a 270 degree phase shift. Thus, by way of 0 and 180 degree feeding of each of first and second pairs of conductive helical strips 130 and 131, and through the use of a differential length "d" of an element within each pair, each of the four elements radiates with a different relative phase, with each phase being separated by 90 degrees. The combination of 90 degree phase shifts between the elements of first and second pairs of conductive helical strips 130 and 131 (with the phase shifts increasing in a clockwise sense when viewed from the top of the antenna) and the left handed twist on the conductors as they ascend to the distal end of the tube create an active mode radiation pattern 40 which possesses a right hand circular polarization.

In a preferred embodiment, the longer of the two strips of each element of first and second pairs of conductive helical strips 130 and 131 is of a slightly greater width (near distal end portion 142 of hollow dielectric tube 140) than the other element of each pair. This difference in width of ore element of first and second pairs of conductive helical strips 130 and 131 allows the differential length "d" to be reduced. Therefore, the self phasing property of dual pattern antenna 20 can be realized while permitting differential length "d" to be minimized, thus reducing the required volume of the antenna.

Figure 5:
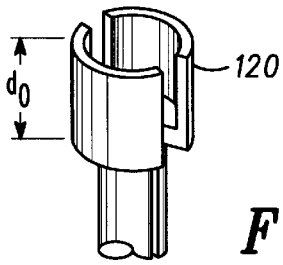
FIG. 5 is an illustration of a split-sheath balun used to as a feed element for a dual pattern antenna for portable communications devices in accordance with a preferred embodiment of the invention.

FIG. 5 is an illustration of a split-sheath balun used to as a feed element (120) for a dual pattern antenna for portable communications devices in accordance with a preferred embodiment of the invention. Although the use of a split-sheath balun is not essential in order to practice the present invention, the technique is viewed as an efficient means of coupling energy from coaxial cable 110 to first and second pairs of conductive helical strips 130 and 131 of FIG. 4. In FIG. 5, the split-sheath balun of feed element 120 comprises two curved surfaces of height "$d_0$". Desirably, height "$d_0$" is determined by the amount of capacitive coupling needed between feed element 120 and first and second pairs of conductive helical strips 130 and 131 of FIG. 4.

Figure 6:
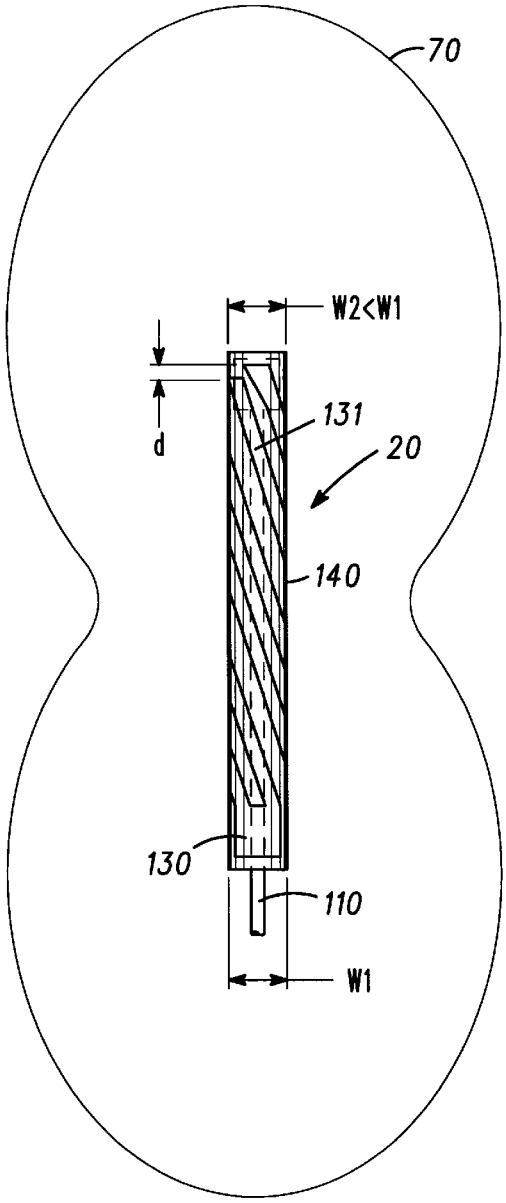
FIG. 6 is an illustration of a second antenna pattern produced by a dual pattern antenna for portable communications devices in accordance with a preferred embodiment of the invention.

FIG. 6 is an illustration of a second antenna pattern produced by a dual pattern antenna for portable communications devices in accordance with a preferred embodiment of the invention. In FIG. 6, feed element 120 is moved to a location within distal end portion 142 of hollow dielectric tube 140, as is contemplated when dual pattern antenna 20 is fully retracted and portable communications device 10 of FIG. 1 has been placed in a quiescent mode. When feed element 120 is moved to a location within distal end portion 142 of hollow dielectric tube 140, this allows capacitive coupling of energy from coaxial cable 110 onto first and second pairs of conductive helical strips 130 and 131. In a preferred embodiment, each of the two constituent portions of the split-sheath balun of feed element 120 is coupled to one of first and second pairs of conductive helical strips 130 and 131 with substantially equal energy being coupled to each element of first and second pairs of conductive helical strips 130 and 131. Through the capacitive coupling of energy onto each element of first and second pairs of conductive helical strips 130 and 131, each pair functions as a single radiating element. This allows dual pattern antenna 20 to function as a bi-filar helical antenna. When dual pattern antenna 20 is functioning as a bi-filar helical antenna, quiescent mode radiation pattern 70 results. As previously mentioned, quiescent mode radiation pattern 70 is desirable since it allows communication signals to be received from and transmitted to remote locations in virtually any direction.

In a preferred embodiment, the wall thickness of hollow dielectric tube 140 varies between proximal end portion 141 and distal end portion 142, with the wall thickness being greater at proximal end portion 141 than at distal end portion 142. This change in thickness provides a decrease in the distance between feed element 120 and first and second pairs of conductive helical strips 130 and 131. This decrease in distance, in turn, increases the capacitance between feed element 120 and first and second pairs of conductive helical strips 130 and 131. Further, when the longer of the two strips of each element of first and second pairs of conductive helical strips 130 and 131 is of a slightly greater width than the other element of each pair, capacitive coupling between feed element 120 and first and second pairs of conductive helical strips 130 and 131 is further increased due to the additional surface area brought about by the increased width. This change in capacitive coupling allows the resonant frequency of dual pattern antenna 20 to be virtually identical when the antenna is operated as either the quadrifilar helical antenna of FIG. 4, or the bi-filar helical antenna of FIG. 6.

Figure 7:
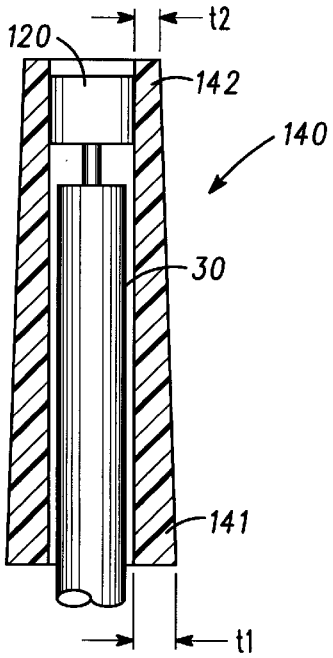
FIG. 7 is an illustration of a technique for changing capacitances between a feed element and conductive helical strips of a dual pattern antenna for portable communications devices in accordance with a preferred embodiment of the invention.

FIG. 7 is an illustration of a technique for changing capacitances between a feed element and conductive helical strips of a dual pattern antenna for portable communications devices in accordance with a preferred embodiment of the invention. In FIG. 7, stem 30 is attached to feed element 120 and coaxial cable 110 of FIGS. 4 and 6 is within stem 30. In FIG. 7, the change in wall thickness of hollow dielectric tube 140 is shown as linearly decreasing from a first value at proximal end portion 141 to a second value at distal end portion 142. As feed element 120 is moved within hollow dielectric tube 140, the linear change in wall thickness from $T_1$ to $T_2$ near distal end portion 142 causes a corresponding change in the capacitance between feed element 120 and any conductive helical strips affixed to hollow dielectric tube 140, such as first and second pairs of conductive helical strips 130 and 131 of FIGS. 4 and 6.

Figure 8:
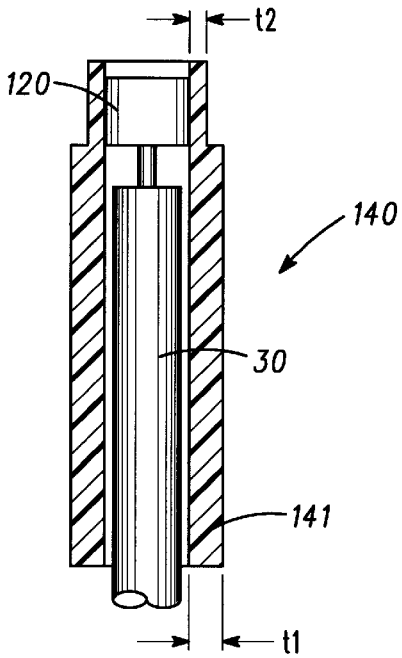
FIG. 8 is an illustration of another technique for changing capacitances between a feed element and the conductive helical strips of a dual pattern antenna for portable communications devices in accordance with a preferred embodiment of the invention.

FIG. 8 is an illustration of another technique for changing capacitances between a feed element and the conductive helical strips of a dual pattern antenna for portable communications devices in accordance with a preferred embodiment of the invention. In FIG. 8, stem 30 is attached to feed element 120 and coaxial cable 110 of FIGS. 4 and 6 is within stem 30. In FIG. 8, an abrupt change in wall thickness of hollow dielectric tube 140 is shown between proximal end portion 141, distal end portion 142. As feed element 120 is moved within hollow dielectric tube 140, the abrupt change in wall thickness, from a first value ($T_1$) to a second value ($T_2$) at proximal and distal end portions 141 and 142, respectively, causes a change in capacitance between feed element 120 and any conductive helical strips affixed to hollow dielectric tube 140, such as first and second pairs of conductive helical strips 130 and 131 of FIGS. 4 and 6.

Figure 9:
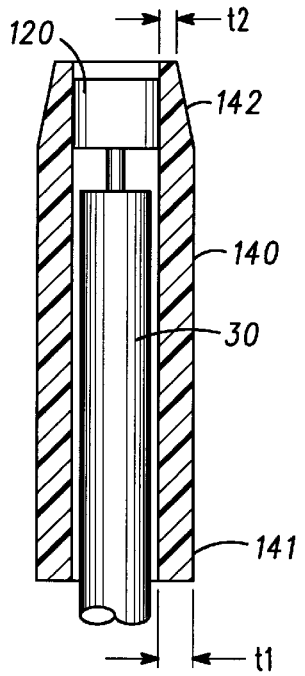
FIG. 9 is an illustration of yet another technique for changing capacitances between feed elements and the conductive helical strips of a dual pattern antenna for portable communications devices in accordance with a preferred embodiment of the invention.

FIG. 9 is an illustration of yet another technique for changing capacitances between feed elements and the conductive helical strips of a dual pattern antenna for portable communications devices in accordance with a preferred embodiment of the invention. In FIG. 9, stem 30 is attached to feed element 120 and coaxial cable 110 of FIGS. 4 and 6 is within stem 30. In FIG. 9, a gradual change in wall thickness of hollow dielectric tube 140 is shown near distal end portion 142. As feed element 120 is moved within hollow dielectric tube 140, the gradual change in wall thickness from a first value ($T_1$) to a second value ($T_2$) near distal end portion 142 causes a corresponding change in the capacitance between feed element 120 and any conductive helical strips affixed to hollow dielectric tube 140, such as first and second pairs of conductive helical strips 130 and 131 of FIGS. 4 and 6.

Figure 10:
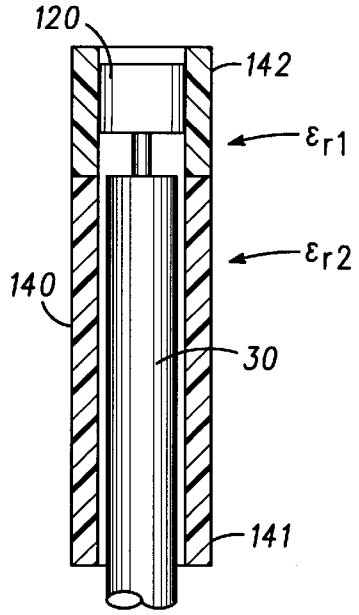
FIG. 10 is an illustration of still another technique for changing capacitances between feed elements and the conductive helical strips of a dual pattern antenna for portable communications devices in accordance with a preferred embodiment of the invention.

FIG. 10 is an illustration of still another technique for changing capacitances between feed elements and the conductive helical strips of a dual pattern antenna for portable communications devices in accordance with a preferred embodiment of the invention. In FIG. 10, hollow dielectric tube 140 is comprised of materials having two different relative dielectric constants at proximal end portion 141, and distal end portion 142. Desirably, the dielectric constant ($\epsilon_{r1}$) of the material used at distal end portion 142 is greater than the dielectric constant ($\epsilon_{r2}$) of the material used at the proximal end portion 141. This change in dielectric constant from a first value to a second (higher) value causes a corresponding change in the capacitances between feed element 120 and any conductive helical strips affixed to hollow dielectric tube 140, such as first and second pairs of conductive helical strips 130 and 131 of FIGS. 4 and 6.

Although FIGS. 6–10 indicate that an increase in the capacitance is required as feed element 120 is moved from a proximal to a distal end portion of hollow dielectric tube 140, a particular application may require that a decrease in capacitance be provided. As mentioned in reference to FIG. 6, the need for an increase in capacitance between feed element 120 and first and second pairs of conductive helical strips 130 and 131 is due to the need for consonance in the resonant frequencies of the quadrifilar and bifilar helical antenna operating modes. However, in alternate embodiments of the present invention, a decrease in the capacitance between feed element 120 and any conductive strips which comprise the antenna may be desired in order to maintain consonance in the resonant frequency ranges as the antenna operating mode is changed.

Figure 11:
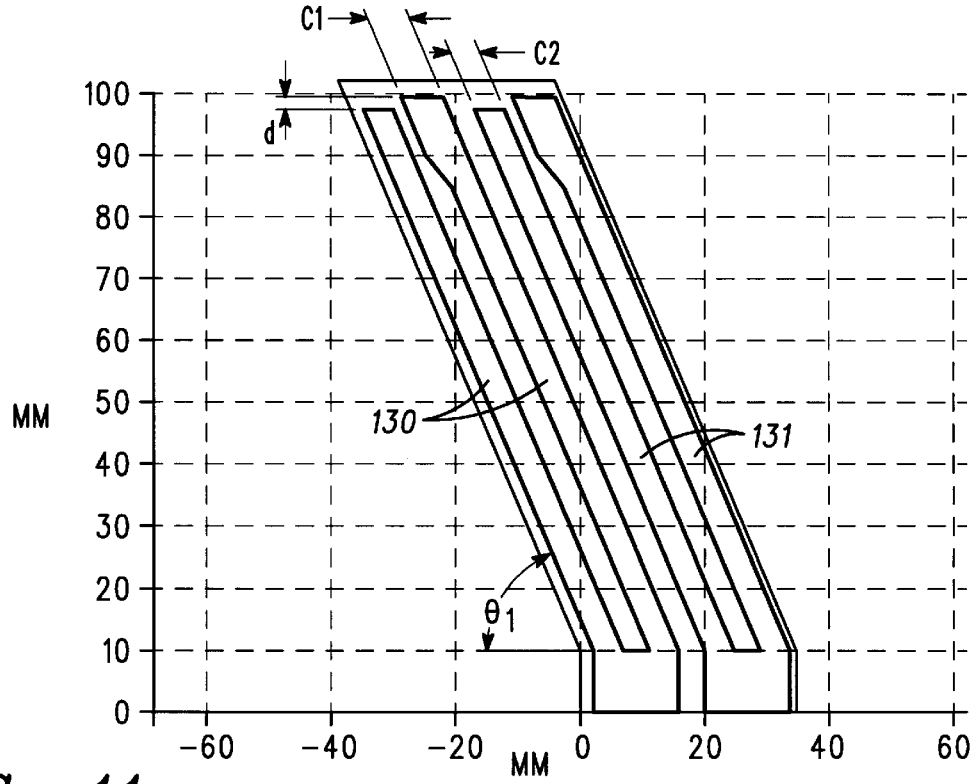
FIG. 11 is an illustration of a mask used to form a dual pattern antenna for portable communications devices in accordance with a preferred embodiment of the invention.

FIG. 11 is an illustration of a mask used to form a dual pattern antenna for portable communications devices in accordance with a preferred embodiment of the invention. In FIG. 11, conductive helical strips 130 and 131 are oriented at a pitch angle denoted as θ. The mask of FIG. 11 can be easily wrapped around a hollow dielectric tube, having a linear decrease in wall thickness from a proximal end to a distal end, such as is shown in FIG. 6. In FIG. 11, first and second pairs of conductive helical strips 130 and 131 are visible. Additionally, the differential length "d" is also visible. Further, one element of each pair of conductive helical strips 130 and 131 can also be seen as being longer as well as of greater width at distal end portion 142 than at proximal end portion 141, as denoted by "$C_1$" and "$C_2$", respectively.

Table 1 provides the dimensions of an exemplary dual pattern antenna for use with a satellite cellular telephone in accordance with a preferred embodiment. These dimensions are representative of a single embodiment of the present invention, in which numerous embodiments are possible.

TABLE 1

| Parameter | Measurement |
|---|---|
| Antenna Height | 101.6 mm |
| Pitch angle ($\Theta_1$, FIG. 11) | 68 degrees |
| Hollow Dielectric Tube Width at Proximal End ($w_1$, FIG. 6) | 11.07 mm |
| Hollow Dielectric Tube Width at Distal End ($w_2$, FIG. 6) | 9.98 mm |
| Wall Thickness at Proximal End($T_1$, FIG. 7) | 1.27 mm |
| Wall Thickness at Distal End($T_2$, FIG. 7) | .725 mm |
| Conductive Helical Strip Width (single conductor at distal end, $C_1$ of FIG. 11) | 6.24 mm |
| Conductive Helical Strip Width (other conductors, $C_2$ of FIG. 11) | 4.12 mm |
| Differential Length (d, FIGS. 4, 6, or11) | 1.91 mm |
| Resonant Frequency | 1616–1626 MHz |
| Return Loss | 15 dB |
| Peak Gain of Quadrifilar Helical Antenna | +3 dB |

From Table 1, it can be seen that the candidate dual pattern antenna exhibits excellent antenna gain and return loss performance. Additionally, the antenna consumes minimal volume making it well-suited for use with a variety of types of portable communications devices.

Figure 12:
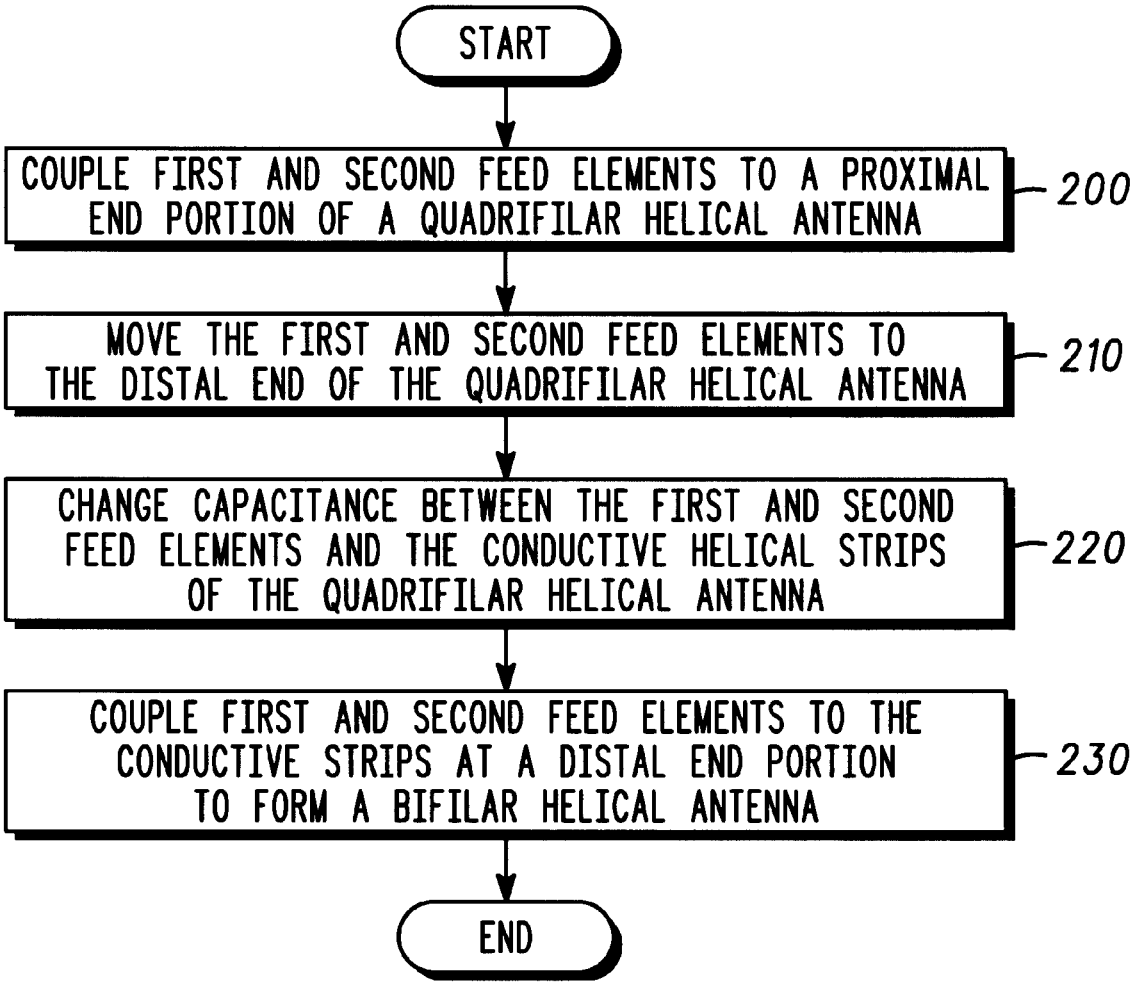
FIG. 12 is a flow chart of a method used in a dual pattern antenna for portable communications devices in accordance with a preferred embodiment of the invention.

FIG. 12 is a flow chart for a method of modifying a radiation pattern of a dual pattern antenna which receives communications signals in accordance with a preferred embodiment of the invention. The dual pattern antenna of Table 1 is suitable for performing the method. In step 200, first and second feed elements are coupled to a proximal end portion of a quadrifilar helical antenna. In step 210, the first and second feed elements are moved from the proximal end portion to the distal end portion of the quadrifilar helical antenna. As a consequence of step 210, step 220 is executed wherein the capacitance value between the first and second feed elements and the conductive helical strips of the quadrifilar helical antenna is changed.

The change in capacitance brought about by step 220 may be the result of a change in distance between the first and second feed elements and the first and second pairs of conductive helical strips of the quadrifilar helical antenna. Alternatively, the change in capacitance in step 220 can result from a change in the dielectric constant of a material which separates the first and second feed elements from the first and second pairs of conductive helical strips of the quadrifilar helical antenna. In another alternate technique of realizing the change in capacitance of step 220, the surface area of the conductive helical strips of the quadrifilar helical antenna is increased at the distal end portion of the antenna. Any of these exemplary techniques can be used in order to increase the capacitive coupling between the first and second feed elements and the conductive helical strips as the first and second feed elements are moved from a proximal to a distal and portion of the quadrifilar helical antenna.

The method continues with step 230 where the first and second feed elements are coupled to the conductive helical strips at the distal end portion in order to form a bi-filar helical antenna. The method terminates thereafter.

A dual pattern antenna for portable communications devices provides a directional radiation pattern that allows a satellite cellular telephone to receive signals from and transmit signals to an orbiting space vehicle. When extended, the antenna functions as a quadrifilar helical antenna producing a radiation pattern with positive gain in the direction above the antenna. The extension also allows the pattern to be free from any interference caused by the head of the subscriber. When retracted, the antenna functions as a bifilar helical antenna producing a substantially omnidirectional antenna pattern allowing the device to receive paging, ring alert, and other communication signals from nearly any direction. Through retraction of the antenna, the portable communications device consumes minimal volume, thus making its use and storage attractive to the consumer.

Accordingly, it is intended by the appended claims to cover all of the modifications that fall within the true spirit and scope of the invention.

What is claimed is:

1. In a communications device, a method for modifying a radiation pattern of an antenna which receives communication signals, comprising the steps of:

coupling first and second feed elements to a proximal end portion of a quadrifilar helical antenna;

moving said first and second feed elements from said proximal end portion to a distal end portion of said quadrifilar helical antenna;

said moving step comprises the step of changing a capacitance from a first value to a second value, said first value being between said first and second feed elements and said first and second pairs of conductive helical strips located at said distal end portion of said quadrifilar helical antenna, and said second value being between said first and second feed elements and said first and second pairs of conductive helical strips located at said proximal end portion of said quadrifilar helical antenna;

said moving step further comprises the step of changing a distance from a first value between said first and second feed elements and said first and second pairs of conductive helical strips to a second value between said first and second feed elements and said first and second pairs of conductive helical strips; and coupling said first and second feed elements to a first pair of conductive helical strips at said proximal end portion of said quadrifilar helical antenna and coupling said second feed element to a second pair of conductive helical strips of said quadrifilar helical antenna to form a bi-filar helical antenna.

2. The method of claim 1, wherein said moving step further comprises the step of changing from a dielectric constant of a first material which separates said first and second feed elements from said first and second pairs of conductive helical strips to a dielectric constant of a second material which separates said first and second feed elements from said first and second pairs of conductive helical strips.

3. The method of claim 1, wherein said moving step further comprises the step of changing a surface area of said conductive helical strips from a first value at said distal end portion to a second value at said proximal end portion.

4. A dual pattern antenna for portable communications devices, comprising:

first and second pairs of conductive helical strips originating at a proximal end portion of said dual pattern antenna and terminating at a distal end portion;

a dielectric tube to which said first and second pairs of conductive helical strips are affixed;

first and second movable feed elements which capacitively couple energy to each of said first and second pairs of conductive helical strips, said first and second movable feed elements occasionally coupling energy at said distal end portion, and occasionally coupling energy at said proximal end portion; and a thickness of said dielectric tube is different at a distal end than at a proximal end.

5. The dual pattern antenna for portable communications devices as recited in claim 4 wherein a dielectric constant of said dielectric tube is different at said distal end portion than at said proximal end portion.

6. The dual pattern antenna for portable communications devices as recited in claim 4, wherein said first and second pairs of conductive helical strips each incorporate a first helical strip which is greater in length than a second helical strip.

7. The dual pattern antenna for portable communications devices as recited in claim 6, wherein said first and second pairs of conductive helical strips each incorporate a first helical strip which is greater in width than a second helical strip at said distal end portion.

8. A portable communications device which incorporates a dual pattern antenna, comprising:

a plurality of conductors arranged in a helical fashion on an outer surface of a dielectric tube, said plurality of conductors extending from a proximal end portion to a distal end portion of said dielectric tube;

a feed element which terminates in a split-sheath balun, said split-sheath balun moving between said proximal end portion and said distal end portion of said dielectric tube, said split-sheath balun occasionally coupling energy from said feed element to said proximal end portion of said dielectric tube, and occasionally coupling energy from said feed element to said distal end portion of said dielectric tube; and said dielectric tube incorporates a wall thickness which is different at said proximal end portion than at said distal end portion.

9. The portable communications device of claim 8, wherein said dielectric tube is conically shaped with a wall thickness that is greatest at said proximal end portion and least at said distal end portion.

10. The portable communications device of claim 8, wherein said dielectric tube incorporates a substantially abrupt change in wall thickness between said proximal and distal end portions of said dielectric tube.

11. The portable communications device of claim 8, wherein said plurality of conductors form a quadrifilar helical antenna, said quadrifilar helical antenna being fed from said proximal end portion by way of capacitive coupling with said split-sheath balun.

12. The portable communications device of claim 8, wherein said plurality of conductors form a bifilar helical antenna when each of two constituent portions of said split-sheath balun capacitively couples to a pair of said plurality of conductors at said distal end portion of said dielectric tube.

13. The portable communications device of claim 8, wherein said dielectric tube incorporates a material possessing a dielectric constant at said distal end portion that is different than at said proximal end portion.

14. The portable communications device of claim 13, wherein said dielectric constant at said distal end portion is greater than at said proximal end portion of said dielectric tube.

15. The portable communications device of claim 8 further comprising a radome which substantially encloses said dielectric tube.

* * * * *